US009441928B1

(12) United States Patent
Geaney et al.

(10) Patent No.: US 9,441,928 B1
(45) Date of Patent: Sep. 13, 2016

(54) METHOD FOR DISCRIMINATING BETWEEN MILITARY OPERATIONS IN URBAN TERRAIN (MOUT) TARGETS

(71) Applicants: John Geaney, Lafayette, NJ (US); Jason Cahayla, West Milford, NJ (US); Lloyd Khuc, Wharton, NJ (US)

(72) Inventors: John Geaney, Lafayette, NJ (US); Jason Cahayla, West Milford, NJ (US); Lloyd Khuc, Wharton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 231 days.

(21) Appl. No.: 14/037,575

(22) Filed: Sep. 26, 2013

Related U.S. Application Data

(60) Provisional application No. 61/816,845, filed on Apr. 29, 2013.

(51) Int. Cl.
*F42B 12/20* (2006.01)

(52) U.S. Cl.
CPC ..... *F42B 12/208* (2013.01); *F42B 12/204* (2013.01)

(58) Field of Classification Search
CPC .... F42B 12/208; F42B 12/204; F42B 12/18; F42B 30/08; F42B 12/625; F42B 12/16; F42C 19/0842; F42C 19/0846; F42C 15/00; F42C 15/196; F42C 9/10
USPC ..... 102/478
See application file for complete search history.

(56) References Cited

U.S. PATENT DOCUMENTS 5,309,843 A * 5/1994 Rentzsch ..... F42B 12/16 102/211
5,542,354 A * 8/1996 Sigler ..... F42B 12/208 102/473
5,698,814 A * 12/1997 Parsons ..... B26F 3/04 102/307
6,910,421 B1 * 6/2005 Gethings ..... F42B 12/16 102/382
7,124,689 B2 * 10/2006 Davis ..... F42C 9/147 102/215
8,091,478 B1 * 1/2012 Khuc ..... F42C 9/147 102/275.3
8,433,460 B1 * 4/2013 Recchia ..... F42B 15/01 382/103
8,522,682 B1 * 9/2013 Genson ..... F42B 12/10 102/221
9,317,477 B1 * 4/2016 Khuc ..... G06F 17/10
2003/0140811 A1 * 7/2003 Bone ..... F42C 9/147 102/266
2007/0051268 A1 * 3/2007 Bissig ..... F42C 15/00 102/476
2009/0013891 A1 * 1/2009 Rastegar ..... F42C 11/02 102/210
2010/0242769 A1 * 9/2010 Helander ..... F42B 12/204 102/216
2011/0041720 A1 * 2/2011 Brill ..... F42B 12/365 102/266
2012/0090490 A1 * 4/2012 Pattison ..... H01H 35/145 102/247
2013/0239837 A1 * 9/2013 Ames ..... F42B 12/208 102/478

* cited by examiner

*Primary Examiner* — Troy Chambers
*Assistant Examiner* — Bridget Cochran
(74) *Attorney, Agent, or Firm* — John P. DiScala

(57) ABSTRACT

A method of autonomously tailoring a detonation delay time of a gun launched munition by utilizing target impact signatures including but not limited to a MOUT target set; earth and timber bunker, triple brick wall, double reinforced concrete, and light armor. While the present method is applicable to countless munition configurations, the projectile architecture used to develop the discrimination algorithm includes a tandem warhead configuration. Upon target impact the forward warhead detonates and pre-damages the target to allow the rear warhead to break through. Target impact data is used to set a detonation delay in the rear warhead providing increased performance behind the target.

7 Claims, 7 Drawing Sheets

METHOD FOR DISCRIMINATING BETWEEN MILITARY OPERATIONS IN URBAN TERRAIN (MOUT) TARGETS

CROSS-REFERENCE TO RELATED APPLICATIONS

This application claims the benefit under 35 USC §119(e) of U.S. provisional patent application 61/816,845, filed on Apr. 29, 2013, titled "Method For Discriminating Between Military Operations In Urban Terrain (MOUT) Targets," which is incorporated by reference in its entirety.

GOVERNMENTAL INTEREST

The invention described herein may be manufactured and used by, or for the Government of the United States for governmental purposes without the payment of any royalties thereon.

FIELD OF THE INVENTION

The present invention generally relates to the field of munitions such as explosive projectiles. Particularly, the present invention relates to a target discriminating munition for use against military operations in urban terrain (MOUT) targets, including but not limited to earth and timber bunkers, triple brick walls, double reinforced concrete, and armored targets. More specifically, the present method relates to an algorithm for use, for example, with a dual warhead design, and is capable of autonomously discriminating between, and defeating numerous targets including a MOUT target set.

BACKGROUND OF THE INVENTION

The survival of a military unit depends to a great extent on its ability to defeat enemy armor and field fortifications. Substantial improvements in the effectiveness of armor and fortifications to withstand exploding munitions has occurred. Reinforced structures are generally designed to deflect the explosive force of a munition away from a target, or to absorb part of the destructive force as a way to dissipate the damaging effects of the munition. Munitions with a delayed warhead detonation, after target impact, have increased effectiveness in damaging or destroying the target.

The delayed timing of an exploding munition, after impact, may be required for several reasons. The purpose of the delay is to produce the greatest target effect or efficiency from the warhead. Some munitions penetrate the target without detonating and then function once inside. Other munitions utilize timing between multiple warheads to create the greatest effect against armor.

In addition to delayed timing, target discrimination is an important factor to produce the optimal penetration. Target discrimination has been under continuous development. One such development includes a bunker defeat munition (BDM), which is a shoulder-fired munition that is capable of discriminating between two targets. These targets are classified as either soft or hard, (i.e., sand or armor) to set a detonation delay time.

Reference is made to U.S. Pat. No. 8,091,478 that describes an exemplary BDM discrimination method, and which is incorporated herein by reference. The BDM discrimination algorithm samples the state of an acceleration switch during a target impact. Following a predetermined sample period, a circuit determines if the majority of samples were logic high or logic low and uses that determination to set an appropriate detonation delay time. The BDM algorithm uses a binary signal from the switch to decide between two outcomes or two target types.

Although this BDM technology has proven to be useful, it would be desirable to present additional improvements. In particular, it would be useful to autonomously discriminate between more than two discrete target media in order to increase munition effectiveness against a wide range of targets.

There is therefore a need for a target discriminating algorithm, which can be implemented into a munition, for use against military operations in urban terrain (MOUT) targets, including but not limited to earth and timber bunkers, triple brick walls, double reinforced concrete, and armored targets. The need for such a target discriminating algorithm has heretofore remained unsatisfied.

SUMMARY OF THE INVENTION

The present invention addresses the challenges of the conventional target discrimination method for munition fuzing, and presents a new target discrimination method for use against multiple discrete targets, including but not limited to earth and timber bunkers, triple brick walls, double reinforced concrete, and armored targets.

In one exemplary embodiment, the autonomous target discrimination algorithm is used in conjunction with a dual warhead munition architecture. This dual warhead configuration includes a forward "precursor" warhead and a secondary "bash-through" warhead.

The fuzing system of the dual warhead munition includes at least one fuze per warhead. In the description of the exemplary embodiment, a precursor fuze is associated with the forward precursor warhead, and a bash-through fuze is associated with the rear bash-through warhead.

Upon projectile impact with the target, the precursor fuze causes the precursor warhead to detonate. The precursor warhead detonation and subsequent bash-through warhead impact event provide a stimulus to the bash-through fuze. This stimulus is used by the bash-through fuze to set a detonation delay time unique to the target impact event.

The dual warhead architecture contributes to a series of stimuli that can be used to build capability into the fuzing system. The first recognizable impulse is the initial impact of the projectile (precursor warhead) on the target. This initial impact event is present whether the munition architecture contains a single or dual warhead.

The second event is the detonation of the precursor warhead. This second event, while present in a dual warhead configuration, may not be available in differing munition architectures. In the case of a single warhead, the initial impact event can be substituted.

The third event is the bash-through warhead target impact.

The final stimulus, or impact event is the bash-through warhead detonation. This fourth event, while not used in the current description, could be utilized to include increased capability into the present discrimination algorithm. The present discrimination algorithm is executed during the time period starting with the precursor warhead target impact event and completing before the bash-through warhead detonation event.

Although the present invention will be described in connection with a dual warhead architecture, it should be understood that the present invention is applicable to a singular (e.g., bash-through) warhead, and could function independently in the absence of a precursor warhead.

To this end, the present method can be used in a munition having a singular warhead, to provide autonomous target discrimination. The method includes the step of sensing an impact between the munition and the target. Upon sensing the impact, the present method allows the munition to break through the target. The present method further uses the impact and the penetration of the munition as stimuli to concurrently monitor a combination of states of a plurality of switches, and to set a selective detonation delay of the munition for providing increased performance behind the target.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
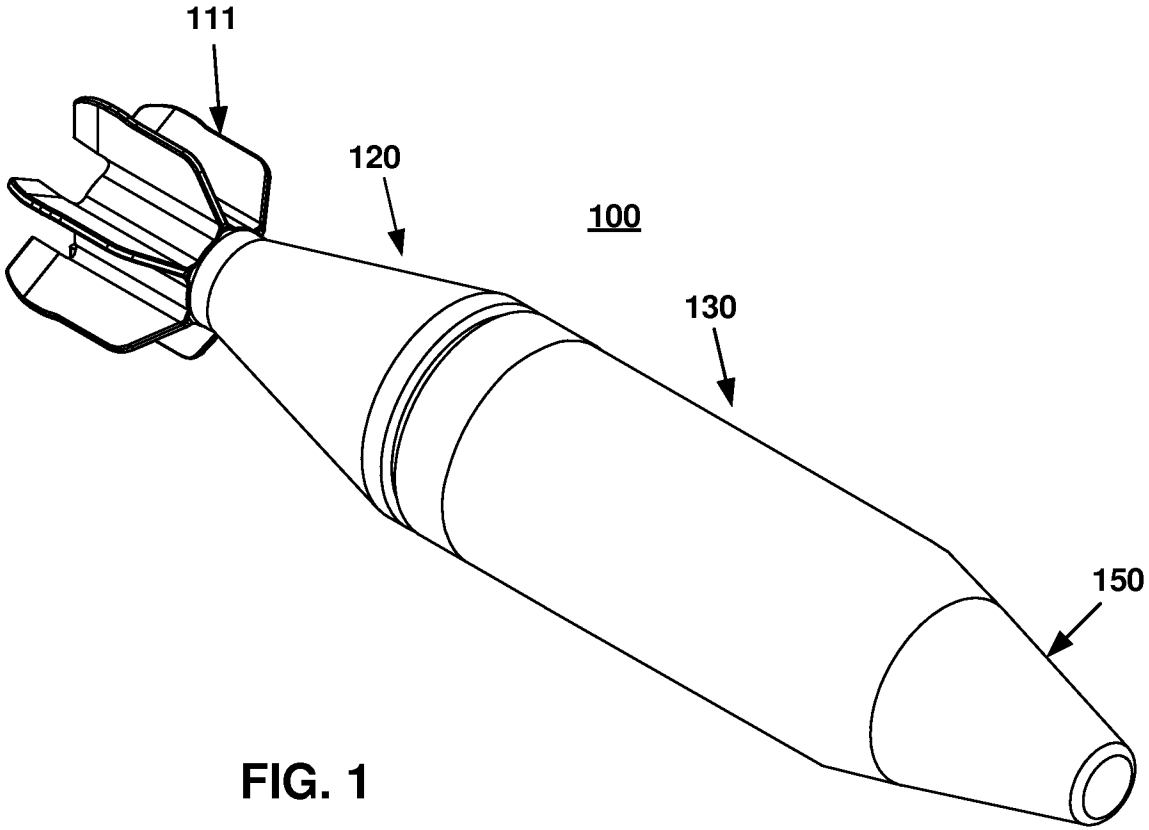
FIG. 1 is an isometric view of an exemplary target discriminating munition for use against military operations in urban terrain (MOUT) targets, including but not limited to earth and timber bunkers, triple brick walls, double reinforced concrete, and armored targets, according to the present invention.
Figure 2:
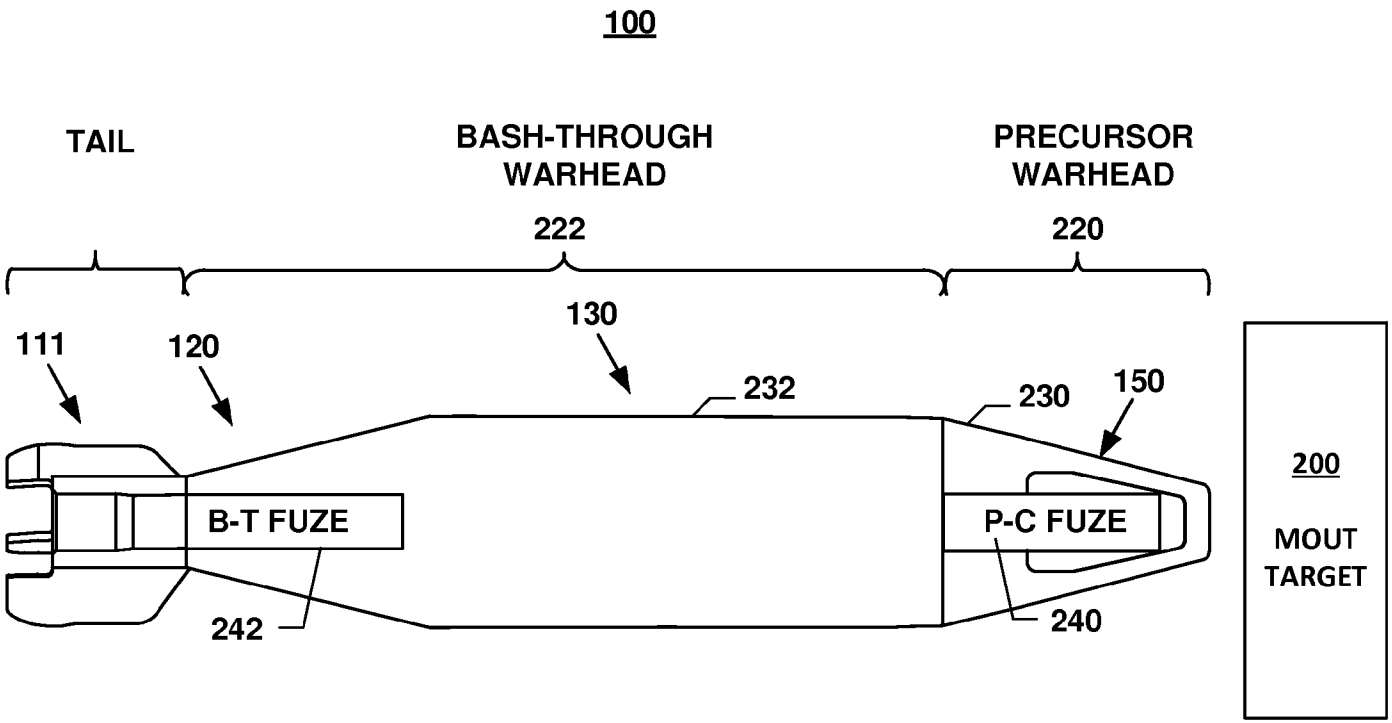
FIG. 2 is a cross-sectional view of the munition of FIG. 1, illustrating the use of a multi-warhead, multi-fuze architecture utilized in the development of the present invention.

With reference to FIGS. 1 and 2, the present invention utilizes an exemplary multi-warhead, multi-fuze, target discriminating munition 100, illustrated herein as a projectile, for use against military operations in urban terrain (MOUT) targets 200, including but not limited to earth and timber bunkers, triple brick walls, double reinforced concrete, and armored targets, according to the present invention.

The munition 100 generally includes a plurality of interconnected sections: a tail for tail section) 111, a rear body 120, a main body 130, and a nose cone 150. The tail 111 generally includes a plurality of fins and possibly a tail boom, as is known in the field. As a result, the tail 111 will not be described in greater detail. Similarly, the nose cone 150 is known in the field and will not be described herein in detail. The outer shape of the nose cone 150 is selected to maintain standard aerodynamic properties.

According to a preferred embodiment of the present invention, the munition 100 comprises a precursor warhead 220 (also referred to herein as forward warhead) and a bash-through warhead 222 (also referred to herein as rear warhead). It should however be understood that the munition 100 does not necessarily require dual warheads and could include a larger number of distributed warheads or a single warhead.

In this exemplary embodiment, the precursor warhead 220 is the nose cone 150 that impacts the MOUT target 200 before the bash-through warhead 222. The bash-through warhead 222 is comprised of the rear body 120 and the main body 130.

The precursor warhead 220 is designed to pre-damage the target 200. The bash-through warhead 222 is designed to penetrate through the damaged target 200 and to detonate after a predetermined delay.

Upon impact of the munition 100 with the target 200, the precursor fuze 240 causes the precursor warhead 220 to detonate. Based on the data collected from the impact of the precursor warhead 220 with the target 200, the detonation of the precursor warhead 220, and the impact of the bash-through warhead 222 with the target 200, the bash-through fuze 242 sets an appropriate detonation delay time for the bash-through warhead 222.

The present dual warhead architecture contributes to a series of stimuli that can be used to build capability into the fuzing system. The first recognizable impulse is the initial impact of the precursor warhead 220 on the target 200. This event is followed by the detonation of the precursor warhead 220. Following the latter detonation is the impact of the bash-through warhead 222 with the target 200. The next stimulus is the detonation of the bash-through warhead 222. The discrimination algorithm that forms part of the fuzing system is executed during the time period between the precursor warhead 220/target 200 impact event and the bash-through warhead 222 detonation event.

Having summarily described the general mode of operation of the munition 100, the design and operation of the munition 100 will now be described in more detail.

Figure 3:
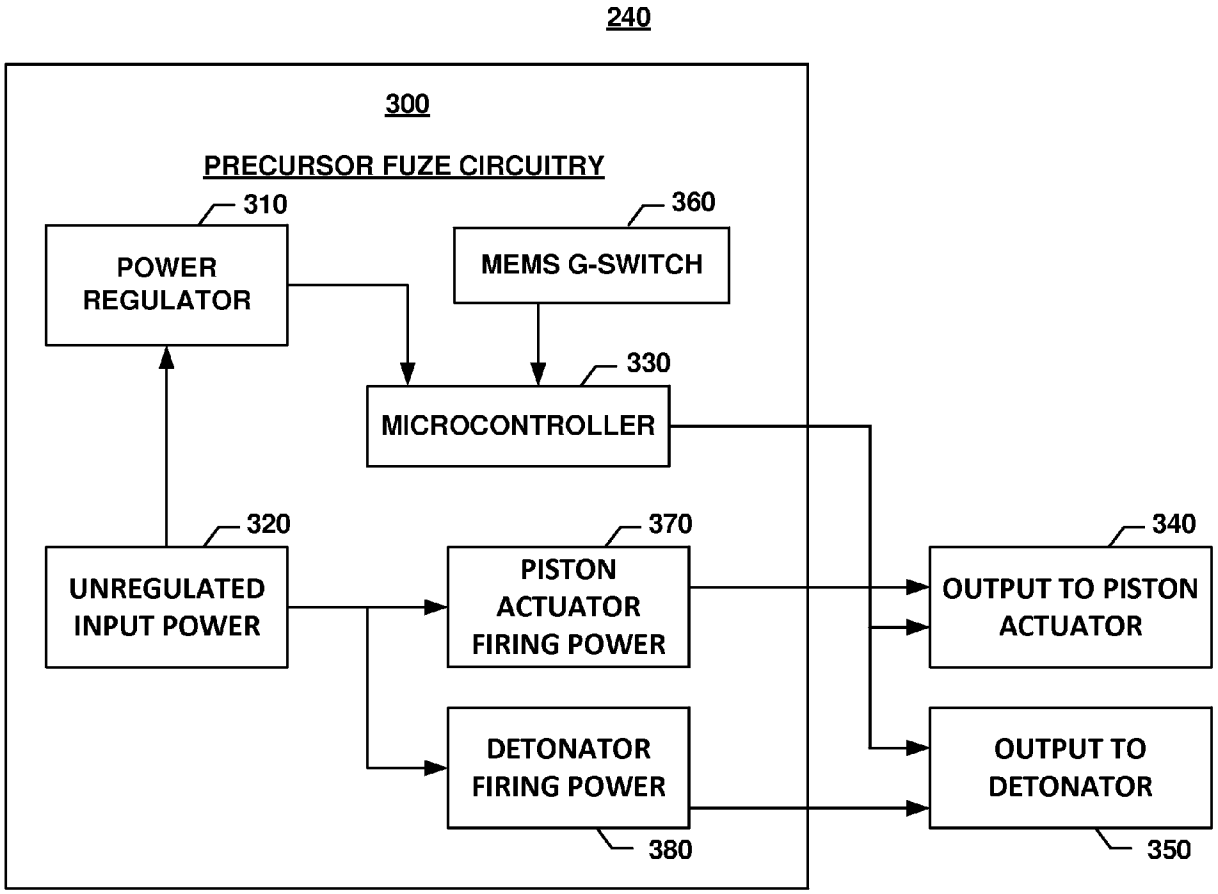
FIG. 3 is a block diagram of a high-level architecture of a precursor fuze circuitry, forming part of the multi-warhead, multi-fuze architecture of FIG. 2.

FIG. 3 is a block diagram of a high-level architecture of a precursor fuze circuitry 300 of the precursor fuze 240. The precursor fuze circuitry 300 generally comprises a power regulator 310, a source of unregulated input power 320, a microcontroller 330, a MEMS G-switch 360, and a pair of firing capacitors for the piston actuator 370 and the detonator 380.

The precursor fuze circuitry 300 generates an output to a piston actuator 340 and an output to a detonator 350. The power regulator 310 controls the level of the power delivered to the microcontroller 330. The microcontroller 330 stores a logic or a software application for authorizing the delivery of the output control signal to the piston actuator 340 included in a safe and arm mechanism (S&A), in order to arm the S&A mechanism.

Additionally, the microcontroller logic controls the delivery of the output control signal to the detonator 350 of the S&A mechanism, in order to detonate the precursor fuze 240.

In addition, the microcontroller 330 receives as input, a status signal from the MEMS G-switch 360, in order to initiate the output to the piston actuator 340 after setback and to initiate the output to the detonator 350 on target impact, as it will be explained later in connection with FIG. 5. The MEMS G-switch 360 has a high natural frequency and a small distance that the MEMS G-switch 360 contact must travel during operation. This affords the MEMS G-switch 360 a fast response time under high frequency stimuli. For this reason, the MEMS G-switch 360 is used to sense the projectile initial impact with the target 200, as it will provide a very fast response.

Figure 4:
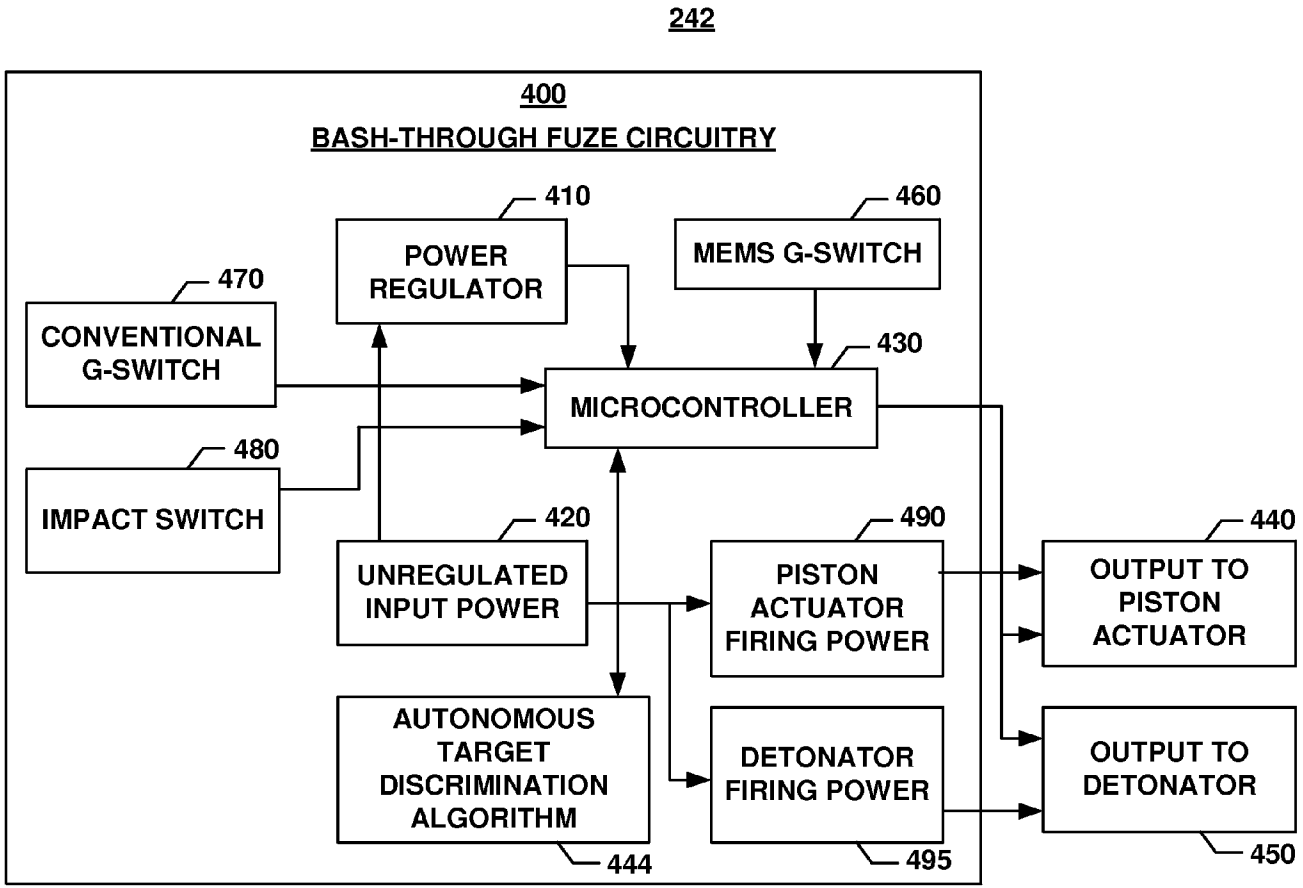
FIG. 4 is a block diagram of a high-level architecture of a bash-through fuze circuitry, forming part of the multi-warhead, multi-fuze architecture of FIG. 2.

FIG. 4 is a block diagram of a high-level architecture of a bash-through fuze circuitry 400, forming part of the bash-through fuze 242. The bash-through fuze circuitry 400 generally comprises a power regulator 410, an unregulated power supply 420, a microcontroller 430, an autonomous target discrimination algorithm (or computer program product) 444, a MEMS G-switch 460, a conventional G-switch 470, an impact switch 480, and a pair of firing capacitors for an output to a piston actuator 440 and an output to a detonator 450.

The bash-through fuze circuitry 400 generates the output to the piston actuator 440 and the output to the detonator 450. The power regulator 410 controls the level of the power delivered to the microcontroller 430. The microcontroller 430 stores a logic or a software application for further authorizing the delivery of an output control signal to a piston actuator of the safe and arm mechanism (S&A), in order to arm the S&A mechanism.

Additionally, the microcontroller logic controls the delivery of the output control signal to the detonator 450 of the S&A mechanism, in order to detonate the bash-through fuze 242.

The microcontroller 430 receives as input, a status signal from each of a MEMS G-switch 460, a conventional G-switch 470, and an impact switch 480, that form part of the bash-through fuze 242, in order to implement the autonomous target discrimination algorithm, as it will be explained later in connection with FIG. 5. While the switch or sensor 470 is referred to herein as "conventional G-switch," it should be understood that this reference is used for clarity of illustration of the present invention, and does not limit the use of the present invention to conventional switches. The conventional G-switch 470 can alternatively be referred to as a 6000 G-switch, or high acceleration switch, as the algorithm can be modified as required by adjusting the threshold value of the conventional G-switch 470.

The conventional G-switch 470 has a lower relative natural frequency than that of the MEMS G-switch 360, and requires that a larger relative distance for the conventional G-switch contact to travel during operation. This affords the conventional G-switch 470 a higher trigger threshold and filtering when exposed to high frequency stimuli. For this reason, the conventional G-switch 470 is used to sense the target penetration, as it requires more energy to trigger.

The microcontrollers 330 and 430 comprise a commercially available microcontroller. In one embodiment, the software application or program that controls the operation of the munition 100 is stored on the microcontrollers 330 or 430. Alternatively, the target discrimination application may be hardware, software, or firmware on any integrated or discrete circuitry, or may comprise a similar analog logic with associated hardware.

Figure 5A:
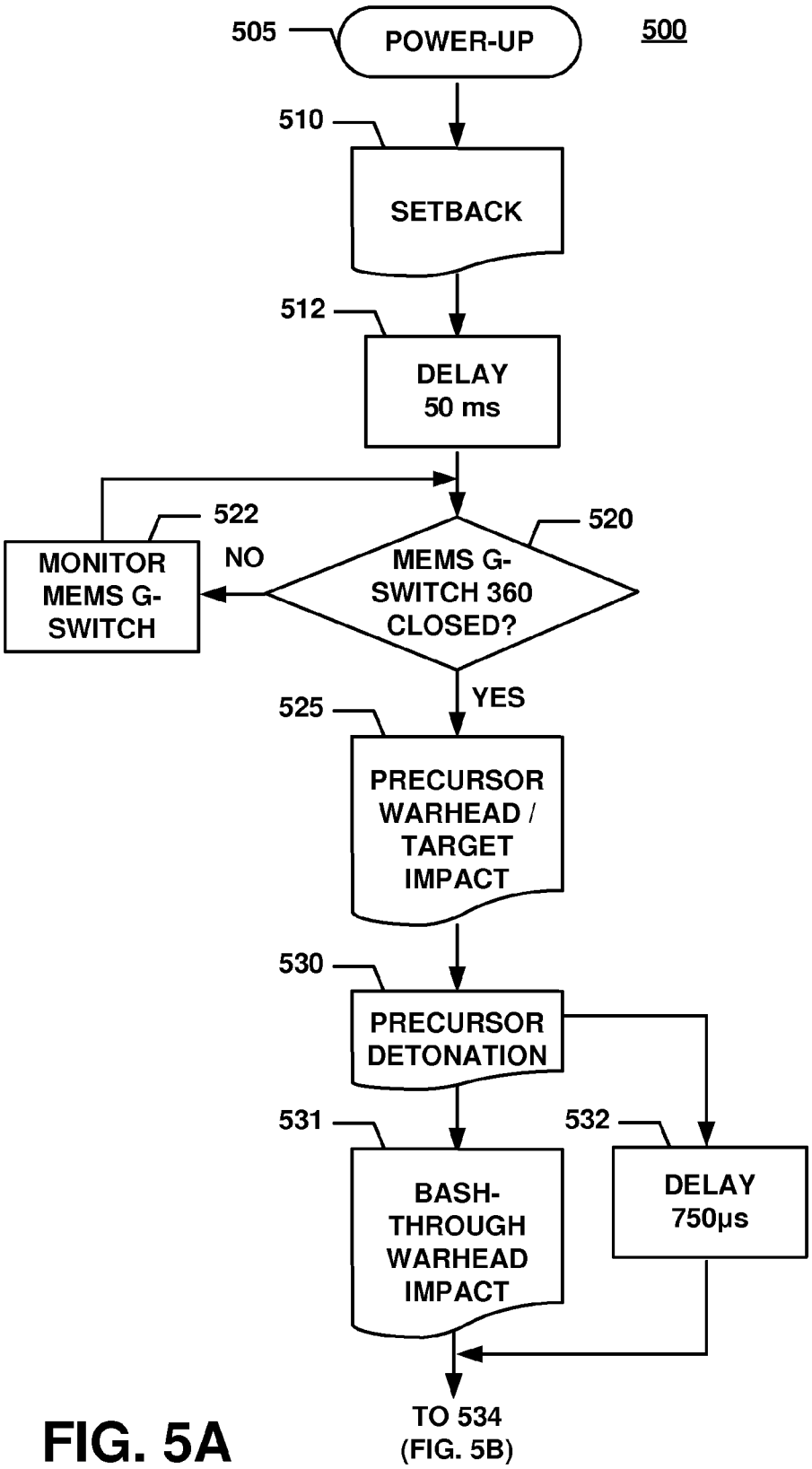
FIG. 5 is comprised of FIGS. 5A and 5B, and represents a flow chart illustrating the method of operation of a munition utilizing the target discriminating algorithm and architecture of FIGS. 1 through 4.
Figure 5B:
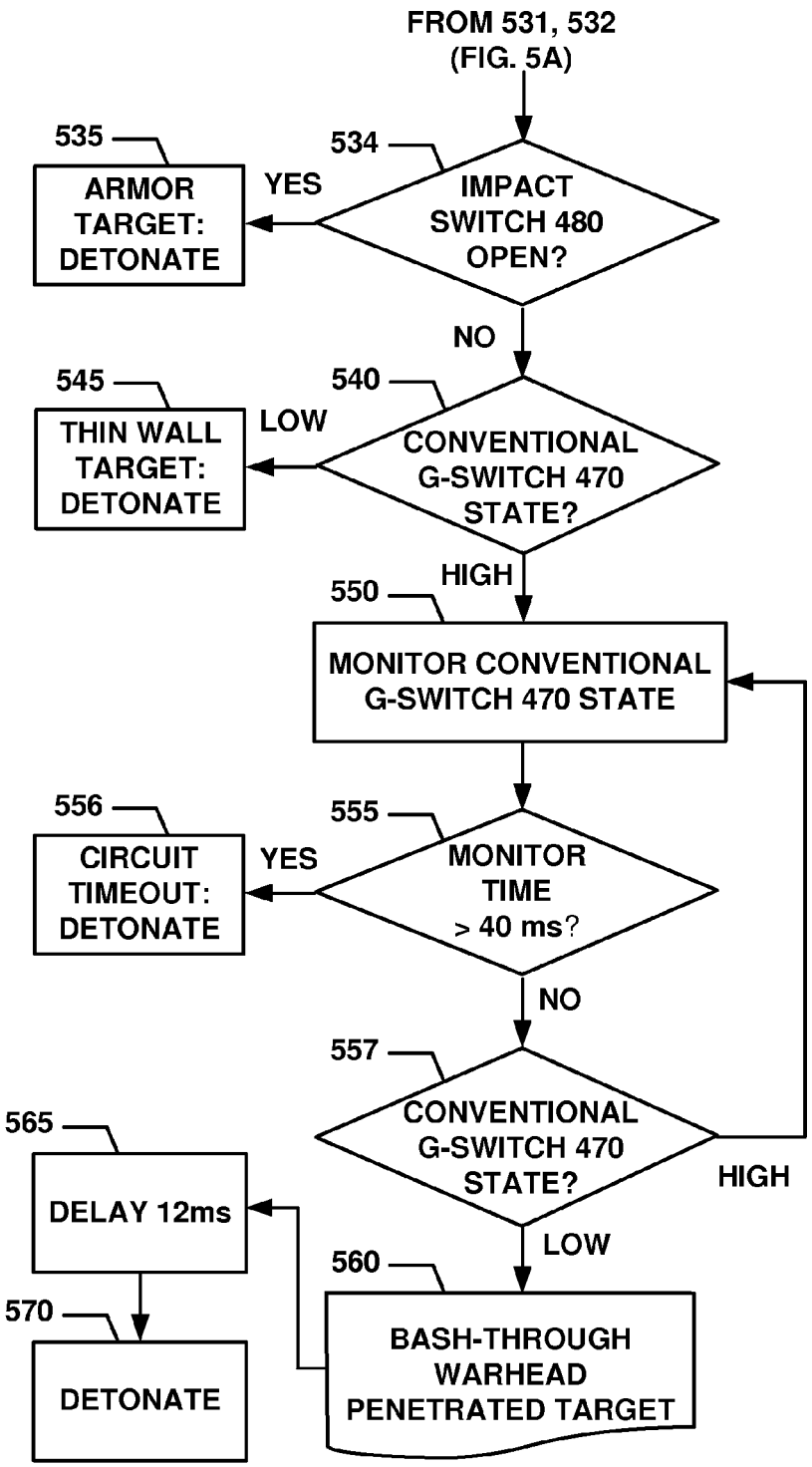

The use and operation of the munition 100 will now be described in more detail, in connection with FIGS. 5 and 6. FIG. 5 includes FIGS. 5A and 5B, and represents a flow chart that illustrates a method (or process) of operation 500 of the target discriminating munition 100 of FIGS. 1 through 4.

Figure 6:
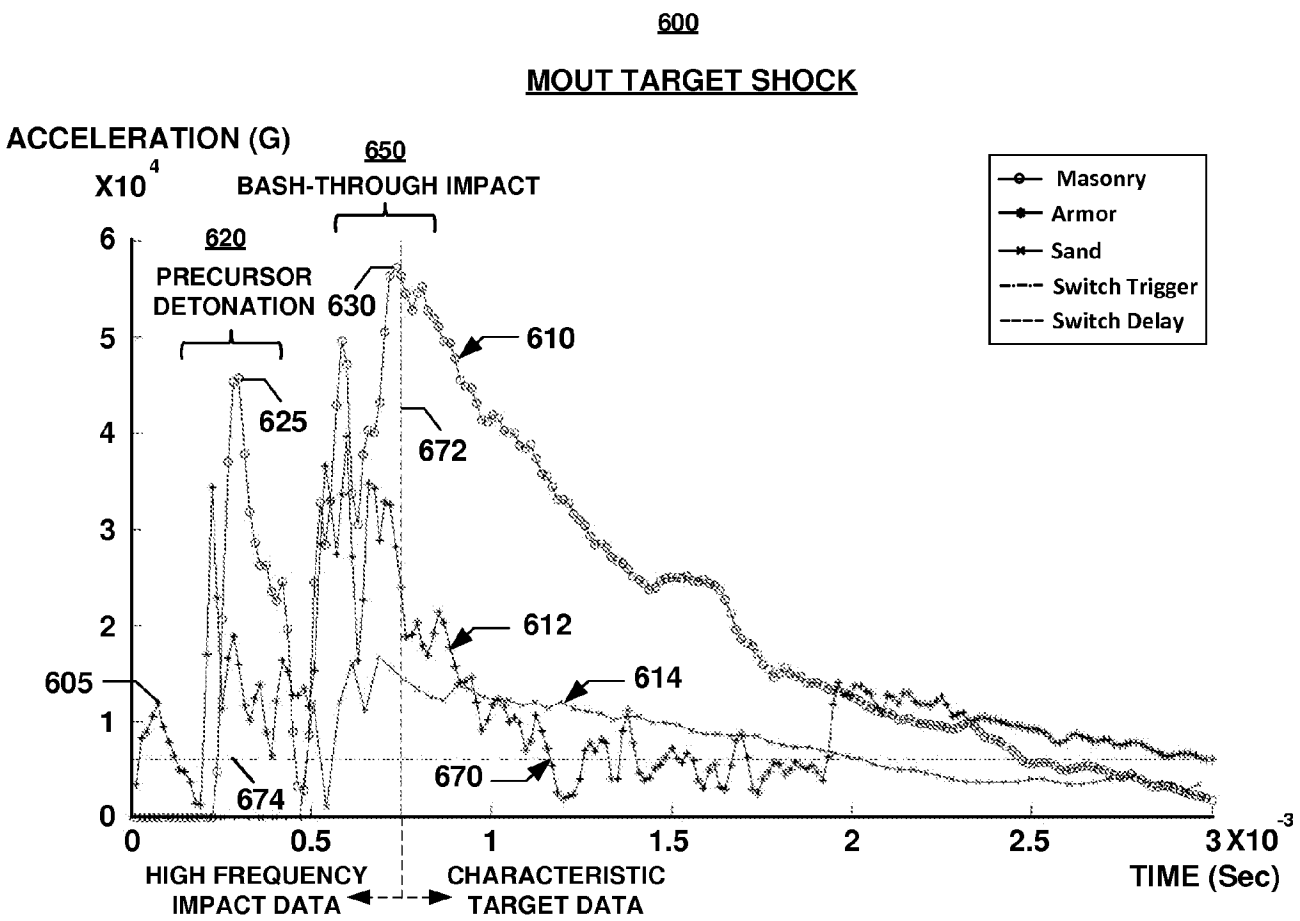
FIG. 6 is a graph illustrating target impact deceleration data utilized by the autonomous target discrimination algorithm, according to the present invention.

FIG. 6 is a graph illustrating target impact deceleration data utilized by the autonomous target discrimination algorithm, as it will be described later in more detail. Graph 600 shows three plots 610, 612, 614 that respectively represent illustrative behaviors of three exemplary MOUT targets 200. Plot 610 illustrates the behavior of a masonry target; plot 612 illustrates the behavior of an armor target; and plot 614 illustrates the behavior of a sand target. For the purpose of clarity and brevity, the present process 500 will be described in connection with plot 612.

At step 505 of FIG. 5A, the process 500 is initiated with the application of unregulated input power 320, 420, to both the precursor fuze 240 (FIG. 3) and the bash-through fuze 242 (FIG. 4), respectively. Each of the precursor fuze 240 and the bash-through fuze 242 functions independently (i.e., charging, sensing launch, arming, etc.) beginning at step 505.

A setback event 510 resulting from the launch is sensed by a temporary closure of the Micro Electro Mechanical Systems (MEMS) G-switches (360 of FIGS. 3 and 460 of FIG. 4). At steps 520, 522, and following a predetermined brief delay 512 [e.g., in the range of approximately 50 ms to allow the MEMS G-switches (360 FIGS. 3 and 460 FIG. 4) to relax and return to the open state] from the onset of the setback event 510, the microcontrollers (330 of FIG. 3, and 430 of FIG. 4) start monitoring the MEMS G-switches (360 of FIGS. 3 and 460 of FIG. 4) for a subsequent change in state initiated by target impact. It should be clear that while exemplary numeral values are provided throughout the present description for illustration purpose, these values are not exclusive, will vary based on munition configuration, and do not in any way limit the present invention to these specific values.

If at decision step 520, the microcontrollers (330 of FIG. 3, and 430 of FIG. 4) determine that the MEMS G-switches (360 of FIGS. 3 and 460 of FIG. 4) remain opened, and thus do not detect a change in state, the microcontrollers (330 of FIG. 3, and 430 of FIG. 4) continue monitoring the MEMS G-switches (360 of FIGS. 3 and 460 of FIG. 4), until a change in state is detected by the microcontrollers (330 of FIG. 3, and 430 of FIG. 4). It should be reiterated that the response of the MEMS G-switches (360 of FIGS. 3 and 460 of FIG. 4) are completely independent of one another, as well as the associated responses of the microcontrollers (330 of FIG. 3, and 430 of FIG. 4).

Upon target impact of the precursor warhead 220, the MEMS G-switches (360 of FIGS. 3 and 460 of FIG. 4) will change state (i.e., close). The change of state will be detected by the microcontrollers (330 of FIG. 3, and 430 of FIG. 4) at step 525 of the process 500. Furthermore, and with reference to plot 612 of graph 600 (FIG. 6), the initial impact of the precursor warhead 200 with the target 200 is shown as peak 605.

The initial precursor target impact 525 is followed by the detonation of the precursor warhead 220 at step 530 of FIG. 5A, and as further illustrated by peak 625 of the plot 610 (FIG. 6). The detonation of the precursor warhead 220 damages the MOUT target 200, in preparation for the penetration of the bash-through warhead 222.

With further reference to FIG. 5B, once the initial precursor warhead target impact event 525 is sensed, the autonomous target discrimination algorithm 444 (FIG. 4) residing on the microcontroller 430 uses both the initial impact event 525 and the detonation of the precursor warhead 530 as stimuli to start two concurrent functions 532, 534. Depending on the performance of the precursor warhead 220 on the target 200, the bash-through warhead 222 may or may not penetrate the target 200. The munition 100 does not classify the actual material or construction of the target 200. Rather, it uses the ability of the bash-through warhead 222 to penetrate the target 200 for timing the detonation of the bash-through warhead 222.

The first function that is initiated by the microcontroller 430 is the commencement of a delay counter at step 532. In this illustration, an exemplary delay of approximately 750 μs is set at step 532. As stated earlier, the numerical value of this delay could be modified to any acceptable level, depending on the target signature characteristics. The purpose of this delay is to prevent the microcontroller (or microprocessor) 430 from discriminating the high frequency impact signature.

With reference to plot 610 of graph 600 (FIG. 6), this delay is shown as a vertical dashed line 672.

According to the second function 534, the impact switch (also referred to herein as hard target impact switch or sensor) 480 (FIG. 4) is monitored by the microcontroller 430 for a change in state. The impact switch 480 is designed to open (change of state from high to low), when a threshold acceleration level is exceeded in a specific direction, for example when impact occurs with a heavy armor target, or upon an impact event that causes the bash-though warhead 222 to break apart. The hard target impact switch bypasses the target detection logic and forces detonation of the bash-through warhead 222 on impact, in order to prevent the breakup of the bash-through warhead 222 on heavy armor targets 200.

If the bash-through impact event 531 causes the impact switch 480 to open as determined at decision step 534 of process 500, then the microcontroller 430 causes the bash-through warhead 222 to detonate immediately at step 535, on the premise that the MOUT target 200 is not penetrable by the munition 200.

If, however, the bash-through impact event 531 does not cause the impact switch 480 to change state (i.e., to open) as determined at decision step 534, then process 500, proceeds to decision step 540, at the end of the delay period 532. In other terms, the vertical line 672 (FIG. 6) denotes the initiation of the final determination for the timing of the bash-through warhead 222 detonation.

Returning to decision step 540, the microcontroller 430 inquires if the state of the conventional G-switch 470 is low or high. At this time the impact switch 480 could be disabled by the microcontroller 430. However, the impact switch 480 could remain enabled if it is determined (or expected) that a secondary hard target event could occur after the initial impact.

If at decision step 540 the microcontroller 430 determines that the conventional G-switch 470 has opened (its state is now low), then the microcontroller 430 will cause the bash-through warhead 222 to detonate at step 545 on the premise that the target is not a hard target, and that it has already been penetrated by the munition 100. Alternatively, the detonation could be scheduled to occur after a short delay, for example in the range of approximately 15 to 25 μs. Such a model will be experienced during an impact with a thin, light target such as plywood, drywall, or glass.

If, however, at decision step 540 the microcontroller 430 determines that the conventional G-switch 470 remains closed (its state is still high), then the microcontroller 430 will concurrently schedule a timeout following a predetermined period of time, such as 40 msec, and will also start monitoring the state of the conventional G-switch 470 at step 550.

To this end, the microcontroller 430 uses a preset minimum threshold to decide whether or not the bash-through warhead 222 has penetrated the target 200. This minimum threshold is denoted by a horizontal line 674 in FIG. 6 and is set by the threshold trigger level of the conventional G-switch 470. For illustration purpose only, the threshold for this specific embodiment is set at approximately 6,000 Gs. The microcontroller 430 sets a decision logic feedback loop that is executed between the conventional G-switch 470 and the microcontroller 430.

More specifically, if at decision step 555, the process 500 determines that the timeout has been reached, even without a change of state of the conventional G-switch 470, then the microcontroller 430 will cause the bash-through warhead 222 to detonate at step 556, on the premise that the target is soft by comparison and that the munition has sufficiently buried to allow for efficient function.

If however, at decision step 555 the microcontroller 430 determines that, during the current monitor loop, the timeout has not been reached, then the microcontroller 430 inquires at step 557 if the state of the conventional G-switch 470 is low (open) or high (closed). If the state is high, then the microcontroller 430 determines that the minimum threshold 674 (FIG. 6) has not been crossed, and continues to monitor the state of the conventional G-switch at step 550, as well as the time that it has been looping at step 555.

The process 500 will continue this monitoring loop until the first of two conditions is met: either the conventional G-switch opens (step 560), or the timeout has been reached (step 556) as explained earlier. Upon determination at step 557 that the state of the conventional G-switch 470 is low (open), then the microcontroller 430 determines that the bash-through warhead 222 has penetrated the target 200, at step 560, and sets a predetermined delay at step 565, prior to detonation at step 570.

With reference to FIG. 6, a penetration point 670, which is the intersection of plot 612 and the minimum threshold line 674, denotes such penetration of the bash-through warhead 222 through the target 200. For illustration purpose only, the penetration point 670 occurs after approximately 1.25 msec from the initial precursor warhead/target impact event 525.

The setting of the delay at step 565 is intended to ensure that the bash-through warhead 222 has sufficiently penetrated the target 200 prior to detonation. In this embodiment, the delay is set to approximately 12 ms, although other values can alternatively be used.

In this particular embodiment of the munition 100, the combination states of the impact switch 480 and the conventional G-switch 470, identifies a total of six targets including but not limited to a hard target/projectile breakup (535), plywood/drywall/glass target (545), light armor (570), triple brick wall/concrete (570), earth and timber bunker (570), and circuit timeout (556).

It should be understood that other modifications might be made to the present munition design without departing from the spirit and scope of the invention.

What is claimed is:

1. A method for use in a munition having a tandem warhead configuration to provide autonomous target discrimination, wherein the tandem warhead configuration includes a forward warhead and a rear warhead, the method comprising: sensing an impact between the forward warhead and the target; upon sensing the impact, the forward warhead detonating to cause pre-damage to the target, for allowing the rear warhead to break through the target; and using the impact and the detonation of the forward warhead as stimuli to concurrently set a selective detonation delay of the rear warhead and monitor a combination of states of a plurality of switches, for providing increased performance behind the target; wherein sensing the impact between the forward warhead and the target includes monitoring a state of a MEMS G-switch; wherein setting the selective detonation delay includes setting a delay period that is sufficient to prevent a microcontroller from discriminating a high frequency impact signature; wherein monitoring the combination of states of the plurality of switches includes monitoring the state of an impact switch and a G-switch; wherein the impact switch changes from a high state to a low state upon detection of an acceleration that exceeds a predetermined threshold acceleration level in a specific direction; wherein the predetermined threshold acceleration is preset to reflect an impact with a heavy armor target; wherein upon determination that the impact switch has not changed state during the delay period subsequent to the impact between the forward warhead and the target, disabling the impact switch; wherein initiating the determination of the detonation timing of the rear warhead includes monitoring the state of the G-switch; wherein upon determination that the G-switch state has changed, causing the rear warhead to detonate on the premise that the target is not a hard target, and that the rear warhead has already been penetrated by the munition; wherein upon determination that the G-switch state has not changed, concurrently scheduling a timeout and continuing to monitor the state of the G-switch; wherein upon determination that the timeout has been reached, causing the rear warhead to detonate on the premise that the target is soft; wherein upon determination that the timeout has not been reached, continuing to monitor the state of the G-switch until one of two conditions is met; the state of the G-switch changes, and the timeout is reached; wherein upon determination that the state of the G-switch has changed, detonating the rear warhead on the premise that the rear warhead has penetrated the target.

2. The method according to claim 1, wherein setting the selective detonation delay includes setting a delay period of approximately 750 μs.

3. The method according to claim 1, wherein the detection of the acceleration that exceeds the predetermined threshold acceleration level causes a detonation of the rear warhead on impact.

4. The method according to claim 1, wherein causing the rear warhead to detonate includes setting a delay period prior to the detonation of the rear warhead.

5. The method according to claim 1, wherein the timeout is in the range of approximately 40 ms.

6. The method according to claim 1, further comprising setting a predetermined delay, prior to the detonation of the rear warhead.

7. The method according to claim 6, wherein the predetermined delay is approximately 12 ms.

* * * * *